US010449404B2

(12) United States Patent
Wood

(10) Patent No.: US 10,449,404 B2
(45) Date of Patent: Oct. 22, 2019

(54) EXERCISE APPARATUS

(71) Applicant: Barxbell, Inc., Reno, NV (US)

(72) Inventor: Mark Wood, Austin, TX (US)

(73) Assignee: BARXBELL, INC., Reno, NV (US)

( * ) Notice: Subject to any disclaimer, the term of this patent is extended or adjusted under 35 U.S.C. 154(b) by 0 days.

(21) Appl. No.: 14/554,240

(22) Filed: Nov. 26, 2014

(65) Prior Publication Data

US 2016/0144220 A1 May 26, 2016

(51) Int. Cl.

| | |
|---|---|
| ***A63B 21/00*** | (2006.01) |
| ***A63B 21/06*** | (2006.01) |
| ***A63B 23/02*** | (2006.01) |
| ***A63B 23/12*** | (2006.01) |
| ***A63B 21/002*** | (2006.01) |
| ***A63B 21/072*** | (2006.01) |

(52) U.S. Cl.

CPC .... *A63B 21/00185* (2013.01); *A63B 21/0004* (2013.01); *A63B 21/0023* (2013.01); *A63B 21/0601* (2013.01); *A63B 21/072* (2013.01); *A63B 21/4035* (2015.10); *A63B 23/0205* (2013.01); *A63B 23/12* (2013.01)

(58) Field of Classification Search

CPC ... A63B 21/06; A63B 21/072; A63B 21/0724; A63B 21/28; A63B 21/285; A63B 21/0608; A63B 21/065; A63B 21/0722; A63B 21/075; A63B 21/4035; A63B 43/02; A63B 65/00; A63B 65/04; A63B 65/06; A63B 65/12; A63B 65/125; A63B 21/4019; A63B 21/0004; A63B 21/00185; A63B 21/002; A63B 21/0023; A63B 21/0601; A63B 21/0726; A63B 21/4017; A63B 21/4023; A63B 21/4027; A63B 21/4033; A63B 21/4039; A63B 21/4043; A63B 23/02; A63B 23/0205; A63B 23/0233; A63B 23/035; A63B 23/04; A63B 23/12; A63B 23/16; A63B 65/122; A63B 2244/09

USPC ..... 482/106–108, 906

See application file for complete search history.

(56) References Cited

U.S. PATENT DOCUMENTS 3,265,389 A 8/1966 Carlson
3,617,056 A 11/1971 Herbold
(Continued)

FOREIGN PATENT DOCUMENTS

CN 201684344 U 12/2010

OTHER PUBLICATIONS

PCT Application No. PCT/US2015/062632 International Search Report and Written Opinion dated Mar. 8, 2016.

*Primary Examiner* — Gary D Urbiel Goldner
(74) *Attorney, Agent, or Firm* — Bachmann Law Group PC

(57) ABSTRACT

An exercise apparatus includes first, second, third and fourth elongated frame members respectively defining a first, second, third, and fourth frame portion each comprising interior and exterior perimeters. The first frame member can include first, second, third, and fourth segments. The first frame portion can encompass first and second open interior regions. The third frame member can adjoin the first frame member at spaced first and second points on the first frame member and span from the first point to the second point. The fourth frame member can adjoin the first frame member at spaced third and fourth points on the first frame member and span from the third point to the fourth point.

28 Claims, 11 Drawing Sheets

(56) References Cited

U.S. PATENT DOCUMENTS

D232,368 S 8/1974 Shales
D242,936 S 1/1977 Docic
D275,302 S 8/1984 Rotella
4,515,364 A 5/1985 Rotella
4,714,246 A * 12/1987 Parisien ..... A63B 67/20 273/330
4,773,640 A * 9/1988 Kolbel ..... A63B 21/0602 482/108
D302,195 S 7/1989 Orak
4,995,604 A 2/1991 Lynch et al.
5,137,502 A * 8/1992 Anastasi ..... A63B 21/072 482/105
D370,951 S 6/1996 Lazar
5,674,162 A * 10/1997 Ellingson ..... A63B 21/0608 482/110
5,692,944 A * 12/1997 Pellicone ..... A63B 21/0608 273/109
5,692,996 A 12/1997 Widerman
5,709,634 A * 1/1998 Pointer ..... A63B 21/0602 482/105
5,709,637 A * 1/1998 Gow ..... A63B 23/12 482/121
5,718,654 A * 2/1998 Kennedy ..... A63B 21/154 482/102
5,769,426 A 6/1998 Gill
D431,608 S * 10/2000 Lin ..... D21/398
6,319,176 B1 * 11/2001 Landfair ..... A63B 21/06 482/106
D455,182 S * 4/2002 Chu ..... D21/398
D464,095 S 10/2002 Yu
6,702,723 B2 * 3/2004 Landfair ..... A63B 21/06 482/106
D495,014 S 8/2004 Zabel
D508,097 S 8/2005 Perez
6,991,590 B2 * 1/2006 Vigiano ..... A63B 21/06 482/106
7,326,158 B1 * 2/2008 Wang ..... A63B 21/06 482/132
D575,361 S * 8/2008 Davis ..... D21/682
7,785,240 B2 * 8/2010 Stugart ..... A63B 21/06 482/108
7,828,702 B2 * 11/2010 Lien ..... A63B 21/0724 482/106
D629,054 S 12/2010 Mathews
7,972,250 B2 * 7/2011 Viselman ..... A63B 21/072 482/141
D658,729 S * 5/2012 McLoughney ..... D21/682
D660,929 S 5/2012 Fitzpatrick
8,256,031 B2 * 9/2012 Von Kahle ..... B62J 27/00 2/311
D689,153 S 9/2013 Brinkley et al.
8,602,951 B2 * 12/2013 Morris ..... A63B 21/0004 403/202
8,608,628 B2 * 12/2013 Mathews ..... A63B 21/0602 482/108
8,672,816 B2 * 3/2014 Lien ..... A63B 21/0726 29/525.14
D712,987 S 9/2014 Salzedo et al.
8,944,971 B2 * 2/2015 Shorter ..... A63B 21/075 482/107
D725,724 S 3/2015 Bellantuono
D731,006 S 6/2015 Birt
D738,970 S 9/2015 Maribona
D741,961 S 10/2015 Maribona
D752,160 S 3/2016 Widerman
9,364,704 B1 * 6/2016 Kuka ..... A63B 21/0726
D763,541 S 8/2016 Livas et al.
9,492,703 B1 * 11/2016 Lechuga ..... A63B 21/072
9,616,269 B1 * 4/2017 Burosh ..... A63B 21/072
2004/0082445 A1 * 4/2004 Zabel ..... A63B 21/06 482/109
2005/0079963 A1 4/2005 Lin
2005/0187079 A1 * 8/2005 Diakonov ..... A63B 21/0724 482/106
2007/0257970 A1 * 11/2007 Morgan ..... B41J 2/025 347/75
2009/0075792 A1 * 3/2009 Stugart ..... A63B 21/06 482/93
2010/0069206 A1 * 3/2010 Viselman ..... A63B 21/072 482/106
2010/0190607 A1 7/2010 Widerman et al.
2011/0263394 A1 * 10/2011 Viselman ..... A63B 21/00061 482/93
2011/0275494 A1 * 11/2011 Radi ..... A63B 21/0602 482/93
2012/0172182 A1 7/2012 Leier et al.
2012/0309595 A1 * 12/2012 Dike ..... A63B 21/072 482/93
2013/0244843 A1 * 9/2013 Burwell ..... A63B 21/075 482/108
2013/0267390 A1 * 10/2013 Warren ..... A63B 21/0602 482/93
2013/0331746 A1 * 12/2013 Brown ..... A61H 1/00 601/46
2013/0337977 A1 * 12/2013 Kokenis ..... A63B 21/0608 482/8
2014/0256522 A1 * 9/2014 Holt, IV ..... A63B 21/0602 482/110
2014/0357458 A1 * 12/2014 Callanan ..... A63B 21/02 482/129
2016/0144220 A1 5/2016 Wood
2017/0043206 A1 * 2/2017 Wilson ..... A63B 23/0211

* cited by examiner

EXERCISE APPARATUS

CROSS-REFERENCE TO RELATED APPLICATIONS

N/A

FIELD OF THE INVENTION

The present disclosure relates to exercise apparatus. Embodiments provide exercise apparatus compatible with and enabling a number of varied exercises and movements by an individual.

BACKGROUND OF THE INVENTION

In many instances, exercise-based activities require some sort of weight. Past efforts have led to various exercise apparatuses. Despite advances, need exists for improved exercise apparatuses as provided by the subject matter disclosed herein.

BRIEF SUMMARY OF THE INVENTION

In embodiments, the disclosure at hand may include exercise apparatus that is compatible with a number of various exercises and movements by an individual. In embodiments, exercise apparatus may include an elongated first frame member defining a substantially circuital first frame portion. A first frame portion may encompass a first open interior region and a second open interior region. The first frame portion further may include a first interior perimeter and a first exterior perimeter in spaced relation to each other and is defined by the first frame member. The first interior perimeter can be adjacent the first open interior region and second interior region.

In embodiments, a first frame member further may include a first segment opposite a second segment, and a third segment opposite a fourth segment, wherein the first segment and second segment separate the third segment from the forth segment.

In embodiments, an exercise apparatus further may include an elongated second frame member defining a second frame portion. The second frame member can span the first open interior region and adjoin the first frame member at opposite end portions of the second frame member. The second frame member can further separate the first open interior region from the second open interior region along adjacent sides.

In embodiments, exercise apparatus further may include an elongated third frame member defining a third frame portion. The third frame member may adjoin the first frame member at spaced first and second points on the first frame member. The third frame member can span from the first point to the second point in spaced relationship to the first exterior perimeter. A third interior perimeter is spaced from the third segment of the first exterior perimeter by means of a third open interior. The third segment extends from the first point to the second point, The third frame portion further may include a third interior perimeter and a third exterior perimeter in spaced relation to each other and defined by the third frame member.

In embodiments, exercise apparatus further may include an elongated fourth frame member defining a fourth frame portion. The fourth frame member may adjoin the first frame member at spaced third and fourth points on the first frame member. The fourth frame member can span from the third point to the fourth point in spaced relationship to the first exterior perimeter. A fourth interior perimeter is spaced from the fourth segment of the first exterior perimeter by means of a fourth open interior. The fourth segment can extend from the third point to the fourth point. The fourth frame portion further may include a fourth interior perimeter and a fourth exterior perimeter in spaced relation to each other and defined by the fourth frame member.

In embodiments, the third segment may be disposed in opposition to the fourth segment relative to the first frame portion. The third frame member may be disposed in opposition to the fourth frame member relative to the first segment and second segment. The third open interior region may be disposed in opposition to the fourth open interior region relative to the third segment and fourth segment.

These and other aspects of the disclosed subject matter, as well as additional novel features, will be apparent from the description provided herein. The intent of this summary is not to be a comprehensive description of the subject matter, but rather to provide a short overview of some of the subject matter's functionality. Other systems, methods, features and advantages here provided will become apparent to one with skill in the art upon examination of the following figures and detailed description. It is intended that all such additional systems, methods, features and advantages that are included within this description, be within the scope of any claims filed later.

BRIEF DESCRIPTION OF THE DRAWINGS

Novel features believed characteristic of disclosed subject matter will be set forth in claims. The disclosed subject matter, as well as a mode of use, further objectives, and advantages thereof, will best be understood by reference to the following detailed description of an illustrative embodiment when read in conjunction with the accompanying drawings, wherein:

DETAILED DESCRIPTION OF ILLUSTRATIVE EMBODIMENTS

Reference now should be made to the drawings, in which the same reference numbers are used throughout the different figures to designate the same components. It will be understood that, although the terms first, second, third, etc. may be used herein to describe various elements, these elements should not be limited by these terms. These terms are only used to distinguish one element from another element. Thus, a first element discussed below could be termed a second element without departing from the teachings of the present disclosure.

Figure 1:
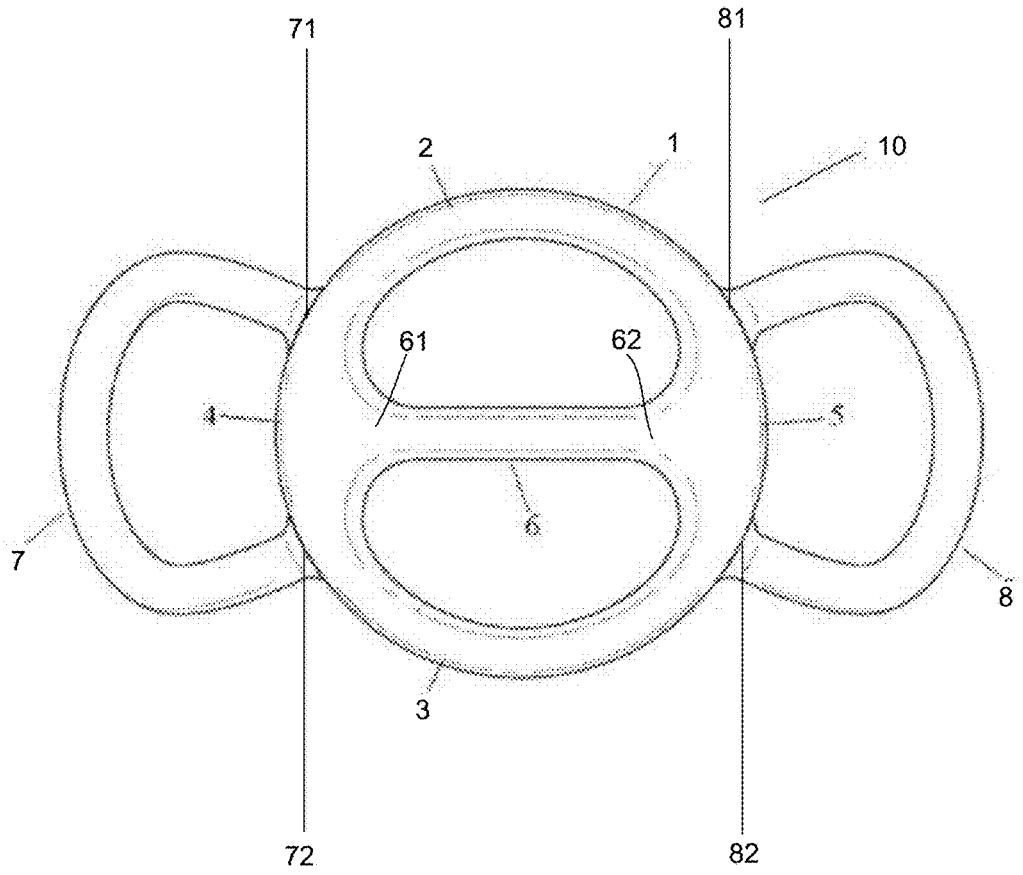
FIG. 1 displays an exercise apparatus in accordance with an embodiment.

FIG. 1 displays exercise apparatus in accordance with an embodiment. In an embodiment illustrated in FIG. 1, the apparatus may include an elongated first frame member 1 defining a substantially circuital first frame portion. The first frame portion encompasses a first open interior region and a second open interior region. The first frame portion further may include a first interior perimeter and a first exterior perimeter in spaced relation to each other and is defined by the first frame member 1. The first interior perimeter is adjacent the first and second open interior regions.

In embodiments, the first frame member 1 further may include a first segment 2 opposite a second segment 3 and a third segment 4 opposite a fourth segment 5, wherein the first segment 2 and second segment 3 separate the third segment 4 from the forth segment 5.

In embodiments, the exercise apparatus further may include an elongated second frame member 6 defining a second frame portion. The second frame member 6 spans the first open interior region and adjoins the first frame member 1 at opposite end portions of the second frame member 6. The second frame member 6 further separates the first open interior region from the second open interior region along adjacent sides.

In embodiments, the exercise apparatus further may include an elongated third frame member 7 defining a third frame portion. The third frame member 7 adjoins the first frame member 1 at spaced first and second points 71 and 72, respectively, on the first frame member 1. The third frame member 7 spans from the first point 71 to the second point 72 in spaced relationship to the first exterior perimeter. A third interior perimeter is spaced from the third segment 4 of the first exterior perimeter by means of a third open interior. The third segment 4 extends from the first point to the second point. The third frame portion further may include a third interior perimeter and a third exterior perimeter in spaced relation to each other and is defined by the third frame member 7.

In embodiments, the exercise apparatus further may include an elongated fourth frame member 8 defining a fourth frame portion. The fourth frame member 8 adjoins the first frame member 1 at spaced third and fourth points 81 and 82, respectively, on the first frame member 1. The fourth frame member 8 spans from the third point 81 to the fourth point 82 in spaced relationship to the first exterior perimeter. A fourth interior perimeter is spaced from the fourth segment 5 of the first exterior perimeter by means of a fourth open interior. The fourth segment 5 extends from the third point to the fourth point. The fourth frame portion further may include a fourth interior perimeter and a fourth exterior perimeter in spaced relation to each other and is defined by the fourth frame member 8.

In embodiments, the third segment 4 may be disposed in opposition to the fourth segment 5 relative to the first frame portion. The third frame member 7 may be disposed in opposition to the fourth frame member 8 relative to the first segment 2 and second segment 3. The third open interior region may be disposed in opposition to the fourth open interior region relative to the third segment 4 and fourth segment 5. In embodiments, one or more of the first frame member 1, second frame member 6, third frame member 7 and fourth frame member 8 may be comprised of a bar.

Figure 2:
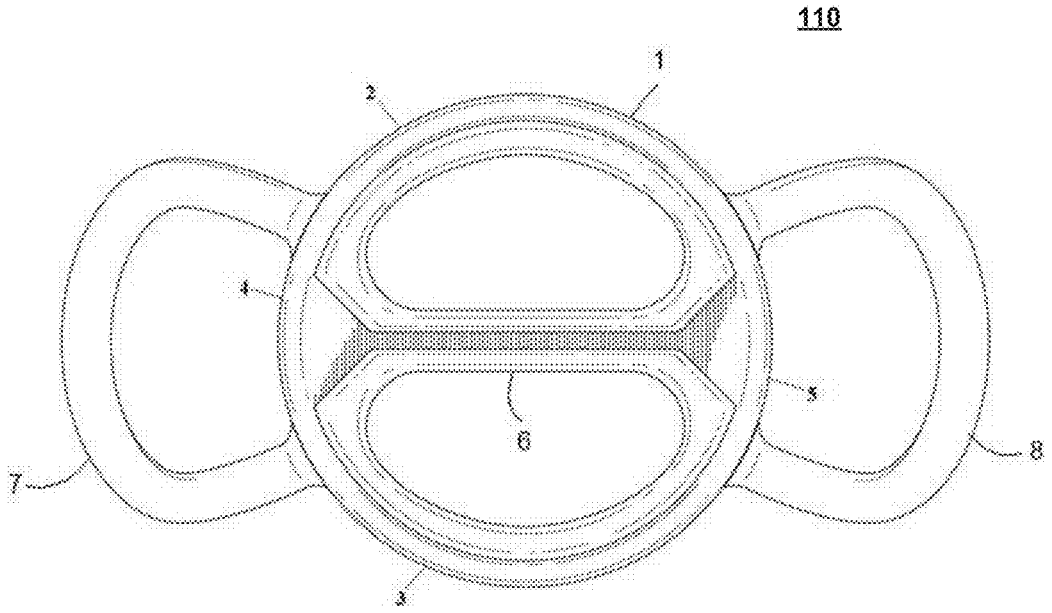
FIG. 2 displays a view of an embodiment of an exercise apparatus with a user's hands on first and second frame members in accordance with an embodiment.

FIG. 2 displays a view of exercise apparatus in accordance with an embodiment. Points exist on the exercise apparatus 110 where the second frame member 6 meets the first frame member 1 (points 61 and 62; see FIG. 1) , the third frame member 7 meets the first frame member 1, and the fourth frame member 8 meets the first frame member 1 that may comprise attachment areas, wherein the attachment areas may be wider in at least one dimension than other embodiments. The edges at the attachment points may also be less rounded than other embodiments. Portions of the first frame member 1 may have a sloped surface. The sloped surface may be found on the interior area of the first frame member 1. A flat section may be found across the second frame member 6.

In embodiments, a user may perform exercises or movements that may work parts of the body such as, but not limited to the abdomen, the arms, the back, the chest, the shoulders, hands, and/or the legs of a user.

In embodiments, at least one of the first frame member 1, second frame member 6, third frame member 7, and fourth frame member 8 may comprise a different thickness in at least one dimension than any of the other frame members. In embodiments, the first frame member 1, second frame member 6, third frame member 7, and fourth frame member 8 may comprise a similar thickness in at least one dimension.

In embodiments, the exercise apparatus may be designated as having a weight between 3 and 25 pounds. Different exercises and movements by an individual may call for the use of different weight in order to benefit from the exercise or movement. Different weighted apparatuses may allow a user to perform specific exercises at a proper weight in relation to the user.

In embodiments, the exercise apparatus may be comprised of a metal. In other embodiments, the exercise apparatus may be comprised of a polymeric material. In certain embodiments, the exercise apparatus may be partially or completely covered in a polymeric coating. In certain embodiments, the exercise apparatus may be comprised of hollow metal members.

Figure 3:
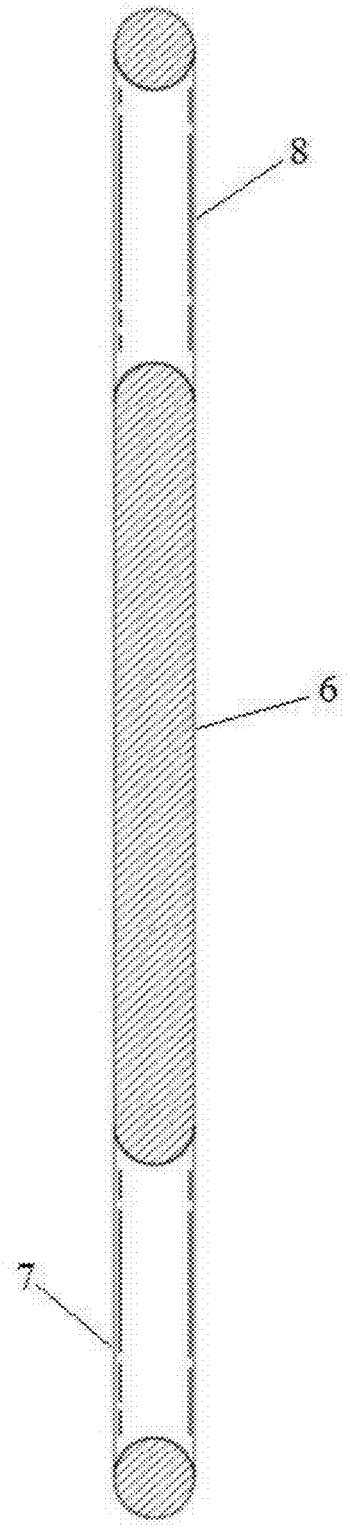
FIG. 3 displays a length-wise cross-section view of exercise apparatus in accordance with an embodiment.

FIG. 3 displays a length-wise cross-section view of exercise apparatus in accordance with an embodiment. In embodiments, the view shows that the third frame member 7 and fourth frame member 8 are both substantially cylindrical in circumference.

Figure 4:
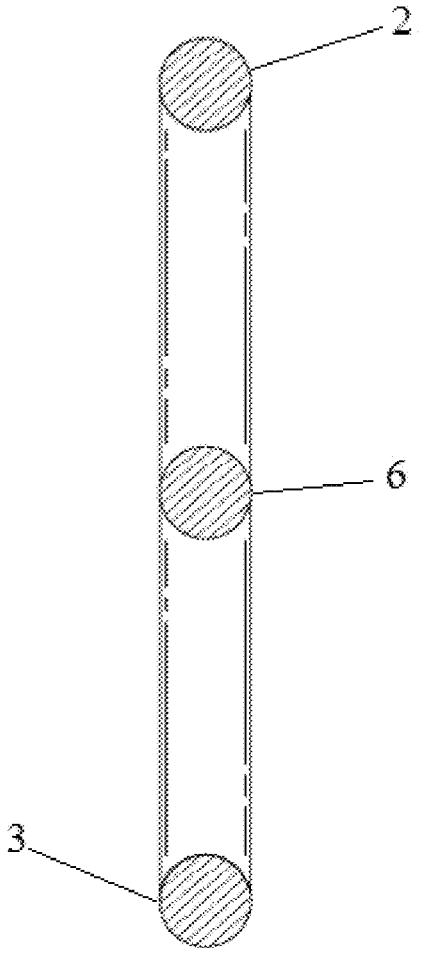
FIG. 4 displays a height-wise cross-section view of an exercise apparatus in accordance with an embodiment.

FIG. 4 displays a height-wise cross-section view of exercise apparatus in accordance with an embodiment. In embodiments, the view shows that the first frame member 1 and fourth frame member 8 are both substantially cylindrical in circumference.

In embodiments, the cross-sections of the first frame member 1, second frame member 6, third frame member 7, and fourth frame member 8 may be a shape other than substantially cylindrical such as, but not limited to: triangular, rectangular, ovular, hexagonal, pentagonal, octagonal, and annular.

Figure 5:
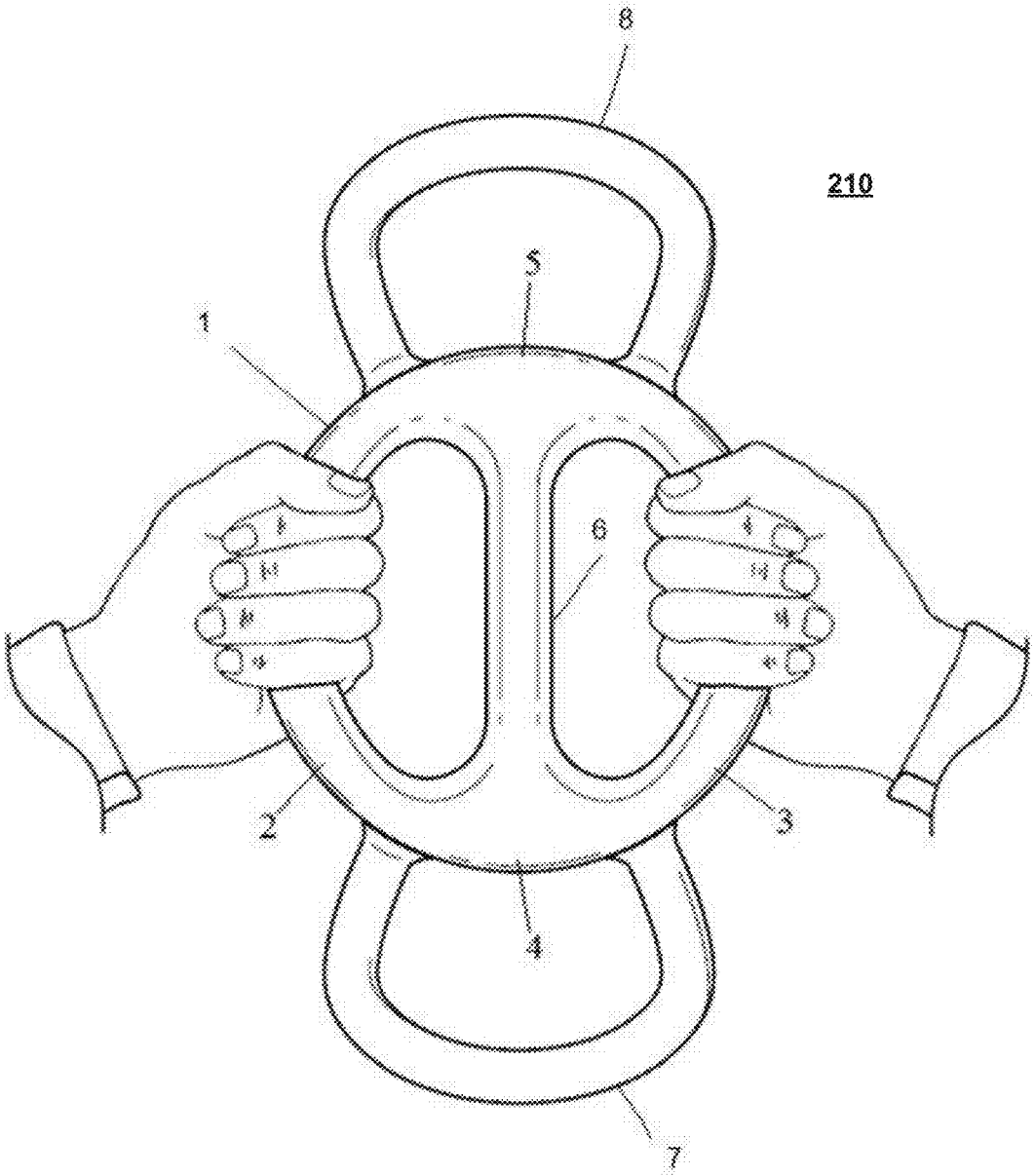
FIG. 5 displays a view of an embodiment of an exercise apparatus with a user's hands on sections of second and third frame portions of first frame member in accordance with one embodiment.

FIG. 5 displays a view of an embodiment of an exercise apparatus 210 with a user's hands on the first frame member 1 in accordance with one embodiment. In embodiments as shown in FIG. 5, the user may perform various exercises and/or movements when one or both of the user's hands are placed on the first frame member 1.

Figure 6:
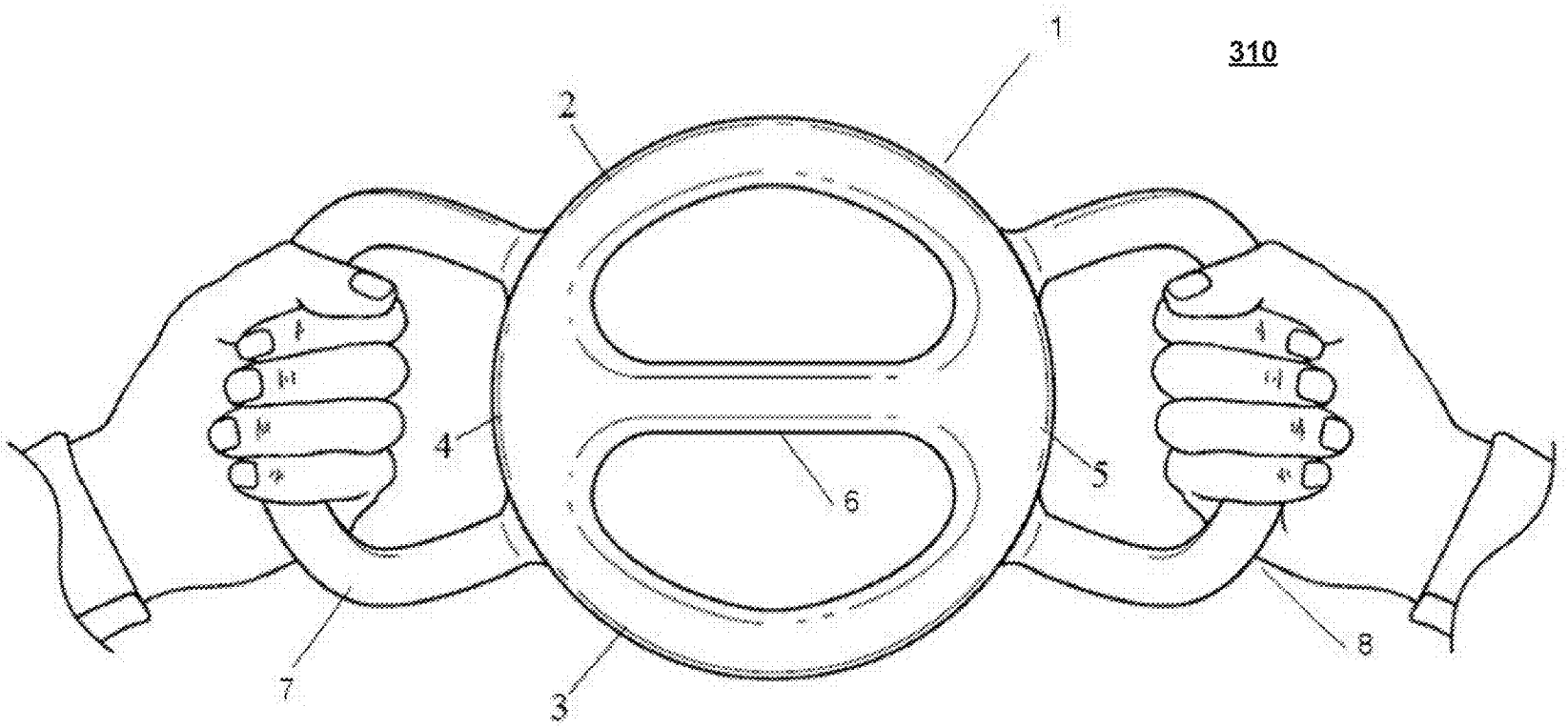
FIG. 6 displays a view of an embodiment of an exercise apparatus with a user's hand on sections of third and fourth frame members in accordance with one embodiment.

FIG. 6 displays a view of an embodiment of an exercise apparatus 310 with a user's hands on sections of the third and fourth frame members 7,8 in accordance with an embodiment. In embodiments, the user may perform various exercises and/or movements when the user's hands are placed on the shown sections of the third and fourth frame members 7,8.

Figure 7:
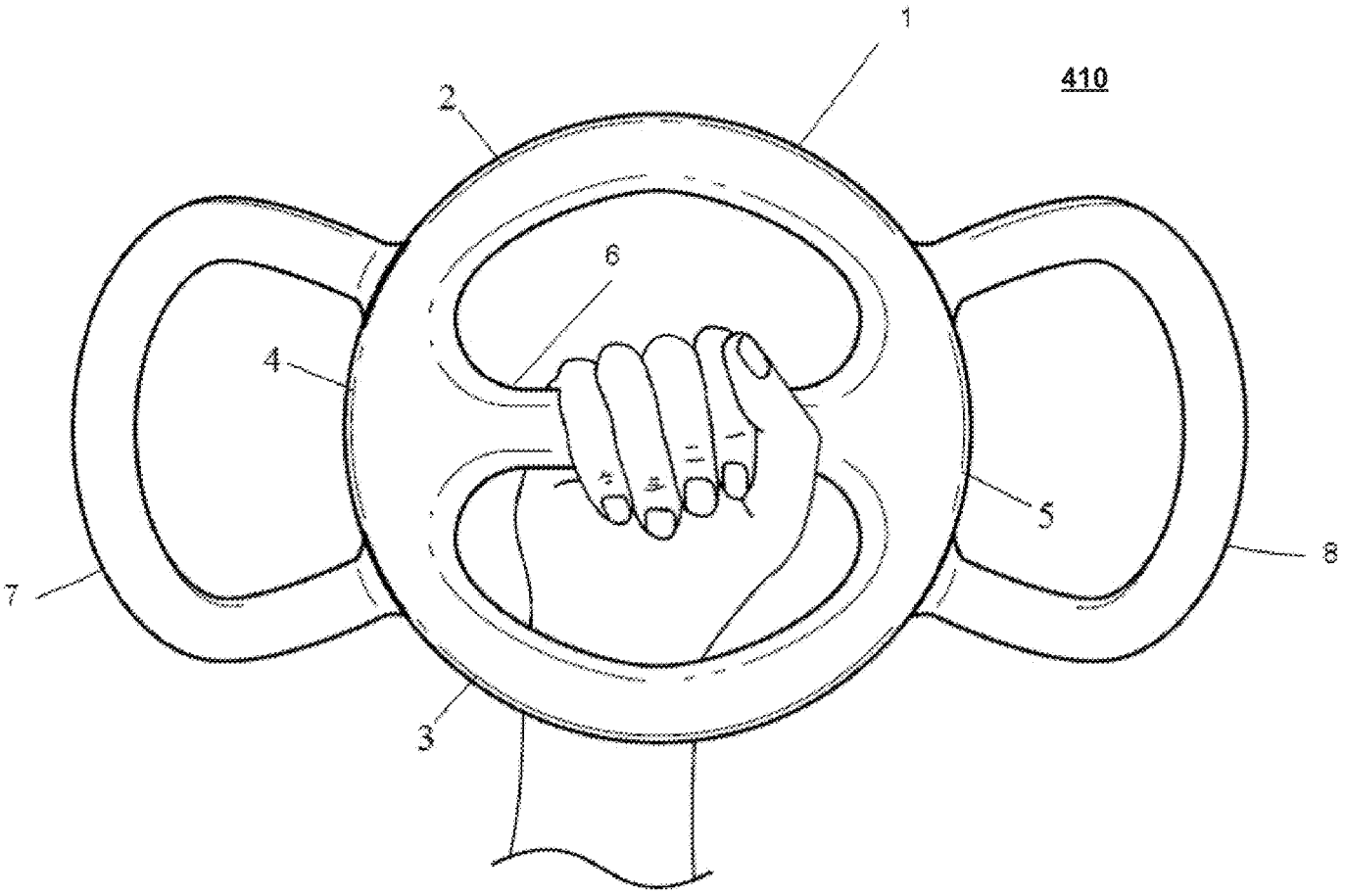
FIG. 7 displays a view of an embodiment of an exercise apparatus with a user's hand palm up on second frame member in accordance with one embodiment.

FIG. 7 displays a view of an embodiment of an exercise apparatus 410 with a user's hand palm up on second frame member 6 in accordance with one embodiment. In embodiments, the user may perform various exercises and/or movements when the user's hands are placed on the shown sections of the second frame member 6.

Figure 8:
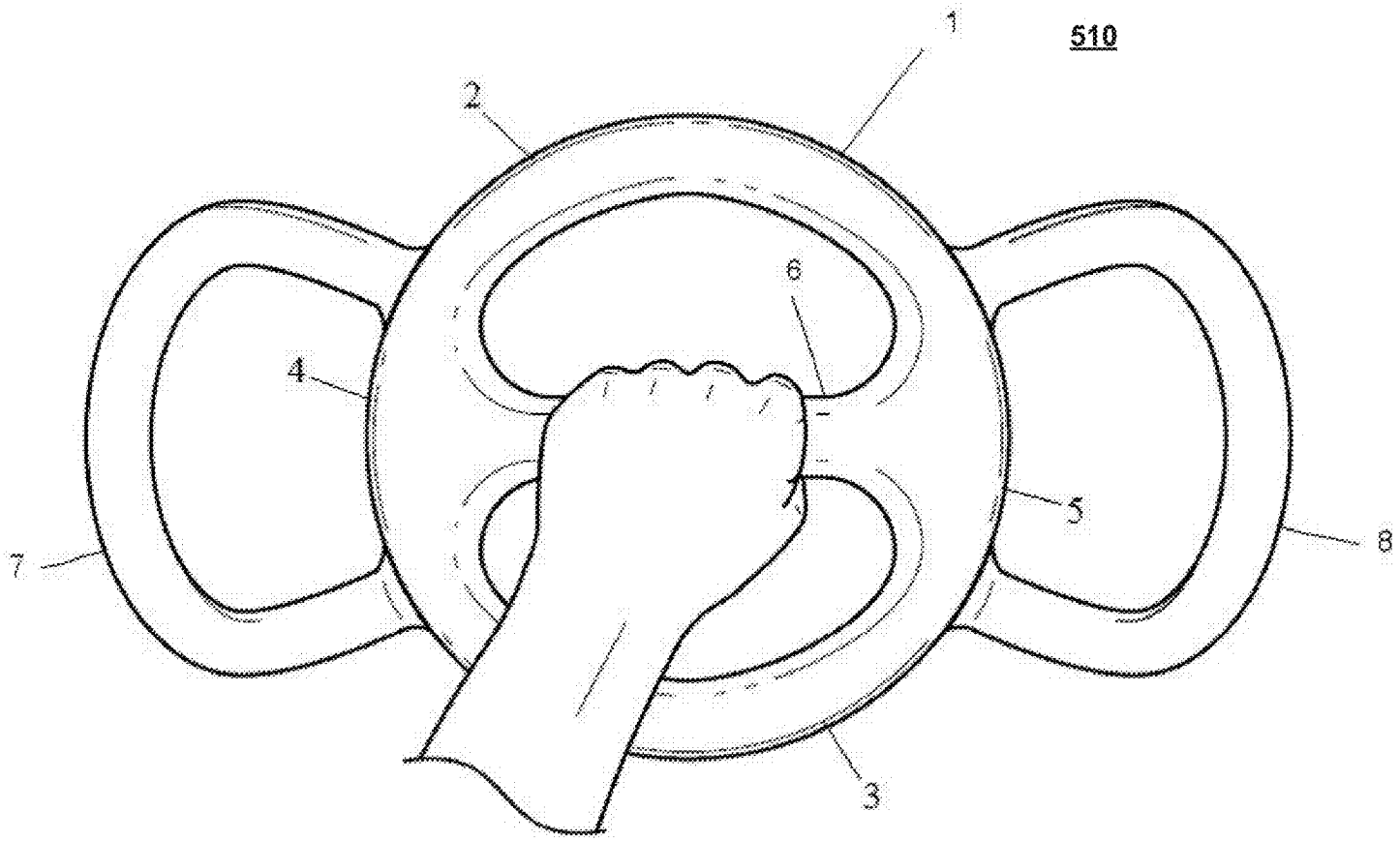
FIG. 8 displays a view of an embodiment of an exercise apparatus with a user's hand palm down on second frame member in accordance with one embodiment.

FIG. 8 displays a view of an embodiment of an exercise apparatus 510 with a user's hand palm down on second frame member 6 in accordance with one embodiment. In embodiments, the user may perform various exercises and/or movements when the user's hands are placed on the shown sections of the second frame member 6.

Figure 9:
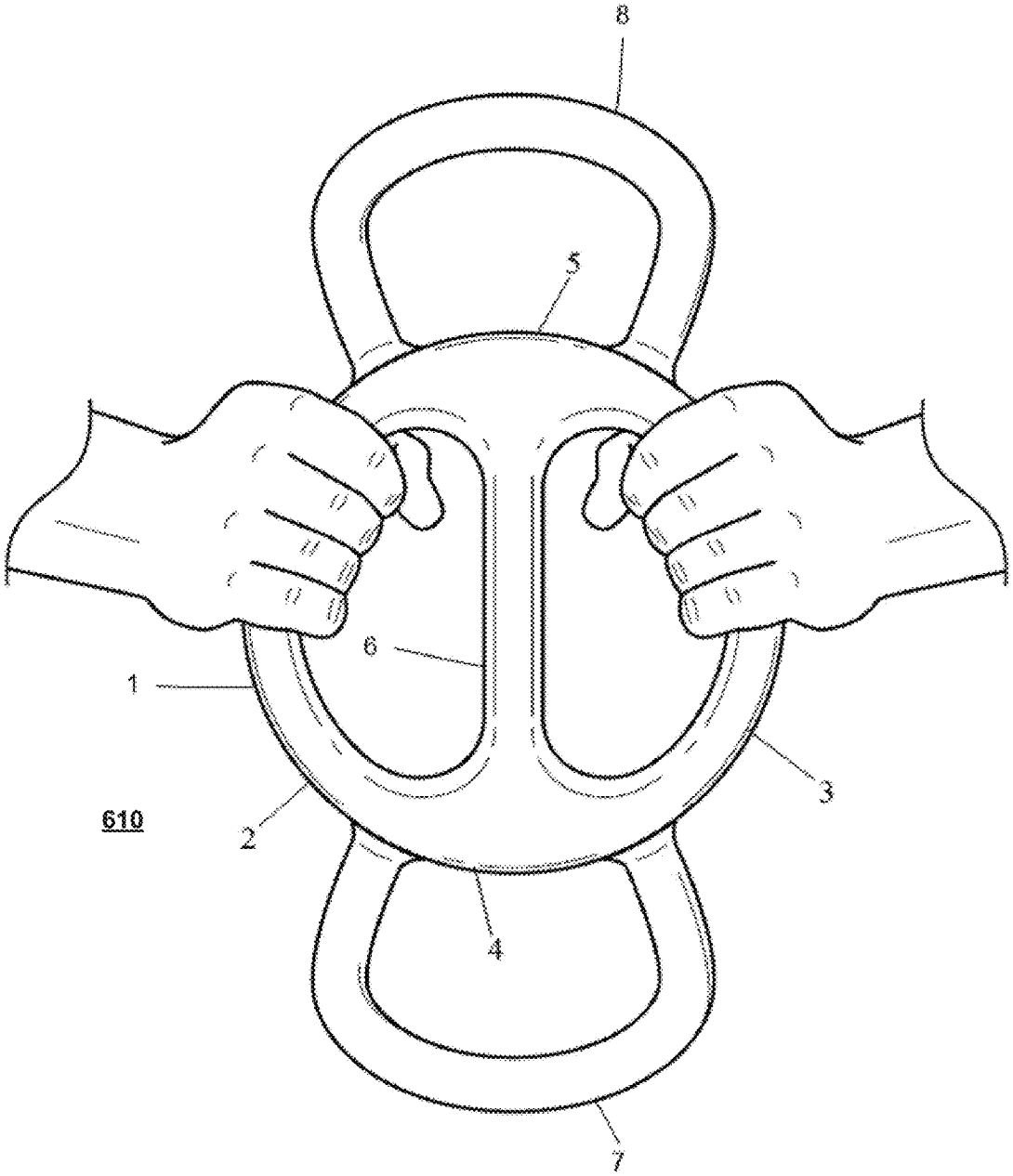
FIG. 9 displays a view of an embodiment of an exercise apparatus with a user's hand on sections of second and third frame portions of first frame member in accordance with one embodiment.

FIG. 9 displays a view of an embodiment of an exercise apparatus 610 with a user's hand on sections of second and third frame portions 2,3 of first frame member 1 in accordance with one embodiment. In embodiments, the user may perform various exercises and/or movements when the user's hands are placed on the shown sections of the second and third frame portions 2,3.

Figure 10:
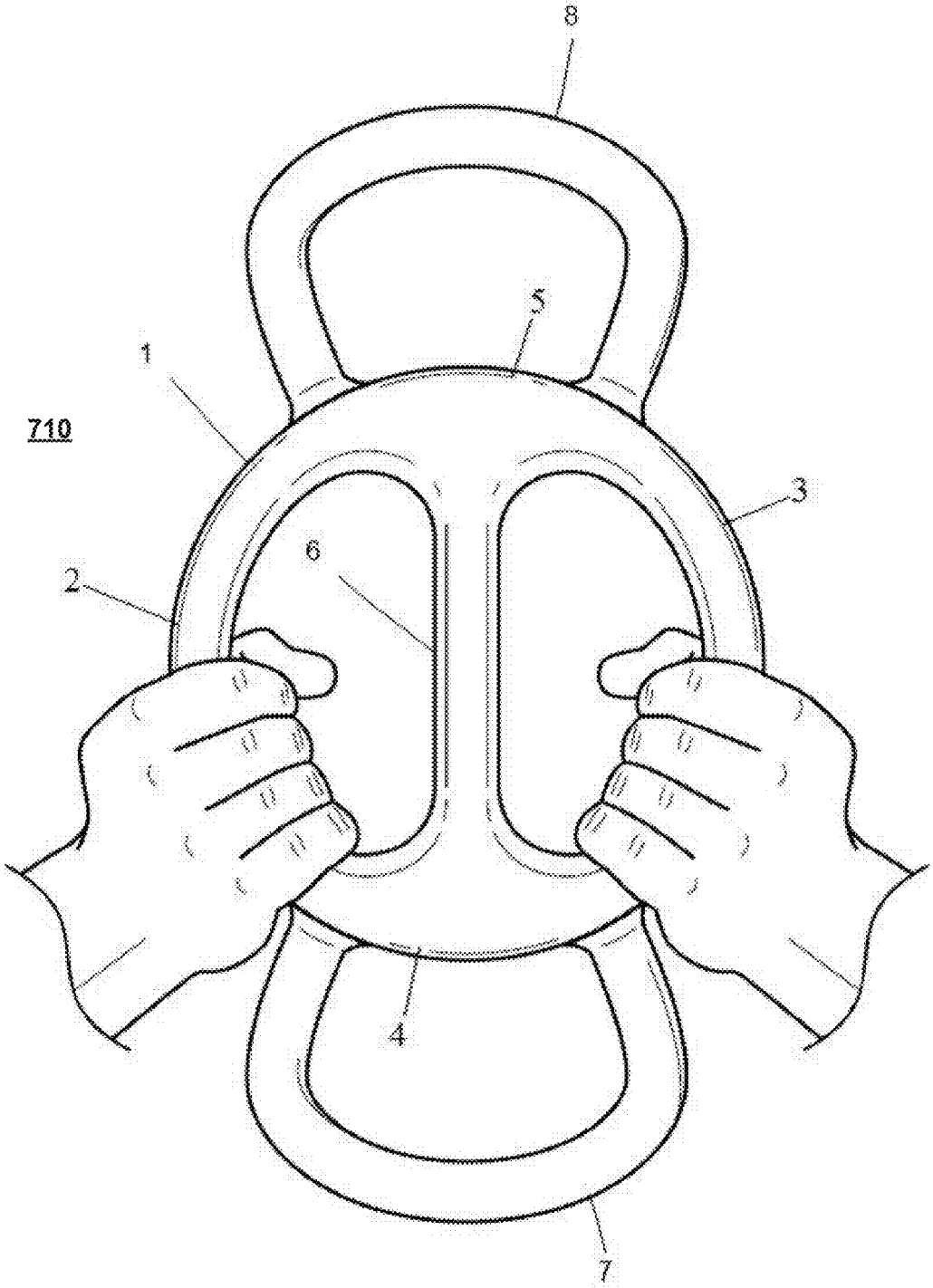
FIG. 10 displays a view of an embodiment of an exercise apparatus with a user's hand on sections of second and third frame portions of first frame member in accordance with one embodiment.

FIG. 10 displays a view of an embodiment of an exercise apparatus 710 with a user's hand on sections of second and third frame portions 2,3 of first frame member 1 in accordance with one embodiment. In embodiments, the user may perform various exercises and/or movements when the user's hands are placed on the shown sections of the second and third frame portions 2,3.

Figure 11:
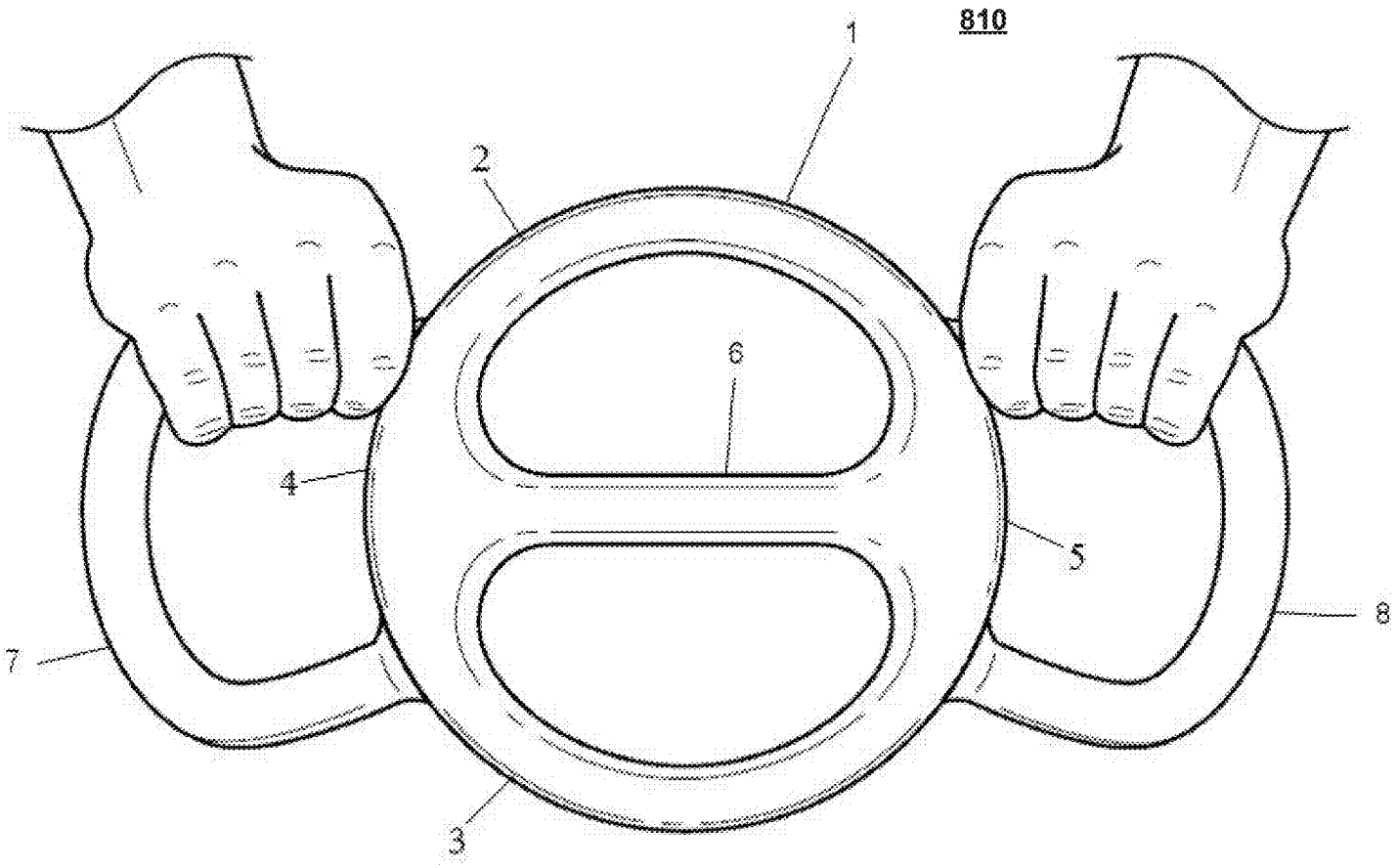
FIG. 11 displays a view of an embodiment of an exercise apparatus with a user's hand on sections of third and fourth frame members in accordance with one embodiment.

FIG. 11 displays a view of an embodiment of an exercise apparatus 810 with a user's hand on sections of third and fourth frame members 7,8 in accordance with one embodiment. In embodiments, the user may perform various exercises and/or movements when the user's hands are placed on the shown sections of the third and fourth frame members 7,8.

In embodiments, a user may grip the exercise apparatus with either one or two hands and with configurations other than those shown in FIG. 2 and FIG. 3. These hand configurations include, but are not limited to: a configuration with one of the user's hands on the first segment 2 of the first frame member 1, a configuration with both of the user's hands on the first segment 2 of the first frame member 1, a configuration with one of the user's hands on the first segment 2 of the first frame member 1 and another of the user's hands on the third segment 4 of the first frame member 1, a configuration with one of the user's hands on the first segment 2 of the first frame member 1 and another of the user's hands on the fourth segment 5 of the first frame member 1, a configuration with one of the user's hands on the first segment 2 of the first frame member 1 and another of the user's hands on the second frame member 6, a configuration with one of the user's hands on the first segment 2 of the first frame member 1 and another of the user's hands on any portion of the third frame member 7, and a configuration with one of the user's hands on the first segment 2 of the first frame member 1 and another of the user's hands on any portion of the fourth frame member 8.

In embodiments, the hand configurations further include, but are not limited to: a configuration with one of the user's hands on the second segment 3 of the first frame member 1, a configuration with both of the user's hands on the second segment 3 of the first frame member 1, a configuration with one of the user's hands on the second segment 3 of the first frame member 1 and another of the user's hands on the third segment 4 of the first frame member 1, a configuration with one of the user's hands on the second segment 3 of the first frame member 1 and another of the user's hands on the fourth segment 5 of the first frame member 1, a configuration with one of the user's hands on the second segment 3 of the first frame member 1 and another of the user's hands on the second frame member 6, a configuration with one of the user's hands on the second segment 3 of the first frame member 1 and another of the user's hands on any portion of the third frame member 7, and a configuration with one of the user's hands on the second segment 3 of the first frame member 1 and another of the user's hands on any portion of the fourth frame member 8.

In embodiments, the hand configurations further include, but are not limited to: a configuration with one of the user's hands on the third segment 4 of the first frame member 1, a configuration with both of the user's hands on the third segment 4 of the first frame member 1, a configuration with one of the user's hands on the third segment 4 of the first frame member 1 and another of the user's hands on the fourth segment 5 of the first frame member 1, a configuration with one of the user's hands on the third segment 4 of the first frame member 1 and another of the user's hands on the second frame member 6, a configuration with one of the user's hands on the third segment 4 of the first frame member 1 and another of the user's hands on any portion of the third frame member 7, and a configuration with one of the user's hands on the third segment 4 of the first frame member 1 and another of the user's hands on any portion of the fourth frame member 8.

In embodiments, the hand configurations further include, but are not limited to: a configuration with one of the user's hands on the fourth segment 5 of the first frame member 1, a configuration with both of the user's hands on the fourth segment 5 of the first frame member 1, a configuration with one of the user's hands on the fourth segment 5 of the first frame member 1 and another of the user's hands on the second frame member 6, a configuration with one of the user's hands on the fourth segment 5 of the first frame member 1 and another of the user's hands on any portion of the third frame member 7, and a configuration with one of the user's hands on the fourth segment 5 of the first frame member 1 and another of the user's hands on any portion of the fourth frame member 8.

In embodiments, the hand configurations further include, but are not limited to: a configuration with one of the user's hands on the second frame member 6, a configuration with two of the user's hands on the second frame member 6, a configuration with one of the user's hands on the second frame member 6 and another of the user's hands on any portion of the third frame member 7, and a configuration with one of the user's hands on the second frame member 6 and another of the user's hands on any portion of the fourth frame member 8.

In embodiments, the hand configurations further include, but are not limited to: a configuration with one of the user's hands on any part of the third frame member 7, a configuration with both of the user's hands on any part of the third frame member 7, and a configuration with one of the user's hands on any part of the third frame member 7 and another of the user's hands on any part of the fourth frame member 8.

In embodiments, the hand configurations further include, but are not limited to: a configuration with one of the user's hands on any part of the fourth frame member 8 and a configuration with both of the user's hands on any part of the fourth frame member 8.

In embodiments, any of the surface areas of the exercise apparatus where any of the above hand configurations may occur may be covered with a polymeric coating. The polymeric coating may provide increased friction between a user's hands and the polymeric coating when the exercise apparatus is being used. This may prevent the exercise apparatus from slipping out of a user's hands. The polymeric coating may further act as markers to a user in order to show the user where to place their hands for certain exercises. In embodiments, multiple polymeric coatings may be put on more than one of the surface areas of the exercise apparatus.

In embodiments, there are a number of exercises and/or movements that a user may perform by gripping the apparatus with one or both of the user's hands. These exercises and/or movements include shoulder exercises including, but are not limited to: front shoulder raises, shoulder press, deltoid raises, arm circles, Arnold press, back flys, incline shoulder raises, rear delt row, shoulder press, bent over side laterals, Rocky press, internal rotations, rear delt row, seated lateral raises, car drivers, chair upper body weighted stretch, circus bells, clean and jerks, clean and press, crucifixes, Cuban press, double jerks, double push press, double snatches, lying one-arm rear lateral raises, lying rear lateral raises, one-arm shoulder press, one-arm upright rows, raises, scaptions, external rotations, front incline raise, internal rotations, iron crosses, jerk balances, pirate ships, seated press, seesaw press, thrusters, Turkish get-ups, kneeling arm drills, landmine linear jammers, lateral raises, lying one-arm lateral raises, lying rear delt raises, one-arm incline lateral raises, one-arm clean and jerks, one-arm jerks, one-arm military presses to the side, one-arm para press, one-arm push press, one-arm snatches, one-arm split jerks, one-arm split snatches, one-arm side laterals, power partials, rack deliveries, reverse flyes, reverse flyes with external rotation, round the world shoulder stretches, seated military press, seated bent-over rear delt raises, seated front deltoid, seated side lateral raises, seesaw press, shoulder circles, shoulder raises, side lateral raises, side laterals to front raises, side wrist pulls, dumbbell raises, single-arm linear jammers, standing alternating press, standing press behind neck, standing Bradford press, standing dumbbell straight-arm front delt raises above head, standing front barbell raises over head, standing deltoid raises, standing military press, standing palm-in one-arm press, standing palms-in press, straight raises on incline bench, two-arm cleans, two-arm jerks, two-arm military press, and upright rows.

In embodiments, the exercises and/or movements further include chest exercises including, but are not limited to: alternating floor press, around the worlds, bench press, guillotine bench press, incline bench press, bent-arm pullovers, butterflies, chest and front of shoulder stretches, decline bench press, decline flyes, decline smith press, extended range one-arm floor press, front raise and pullovers, hammer grip incline bench press, incline bench press with palms facing in, incline flyes, incline flyes with a twist, leg-over floor press, low crossovers, one-arm bench press, one-arm flat bench flye, one-arm floor press, push ups to weighted side plank, straight-arm pullovers, and Svend press.

In embodiments, the exercises and/or movements further include bicep exercises including, but are not limited to: hammer curls, alternate hammer curls, alternate incline curls, incline curls, curls, curls lying against an incline, preacher curls, alternate preacher curls, standing curls, seated curls, concentration curls, cross body hammer curls, drag curls, alternate bicep curls, flexor incline curls, high curls, incline hammer curls, incline inner bicep curls, lying curls, lying high bench curls, lying supine curls, one-arm preacher curls, overhead curls, preacher hammer curls, one-arm preacher hammer curls, reverse curls, reverse preacher curls, seated inner bicep curls, spider curls, standing concentration curls, standing reverse curls, standing inner-bicep curls, standing one-arm curls, standing one-arm curl over incline bench, two-arm preacher curls, Zottman curls, and Zottman preacher curls.

In embodiments, the exercises and/or movements further include tricep exercises including, but are not limited to: skullcrushers, board press, incline tricep extensions, lying tricep extensions, one-arm tricep extensions, overhead tricep extensions, close-grip bench press, decline skullcrushers, decline tricep extensions, floor press, one-arm tricep extensions, pronated grip tricep extensions, incline tricep extensions, lying tricep press, one-arm floor press, one-arm pronated tricep extensions, one-arm supinated tricep extensions, pin presses, reverse triceps bench press, seated bent-over one-arm tricep extensions, seated bent-over two arm tricep extensions, seated tricep press, standing bent-over one-arm tricep extensions, standing bent-over two-arm tricep extensions, standing tricep extensions, standing one-arm tricep extensions, Tate press, and tricep kickbacks.

In embodiments, the exercises and/or movements further include traps exercises including, but are not limited to: shrugs, shrugs behind the back, sumo high pulls, leverage shrugs, snatch shrugs, and standing upright rows.

In embodiments, the exercises and/or movements further include back exercises including, but are not limited to: deadlifts, crossover reverse lunges, deficit deadlifts, hyperextensions, good mornings, seated good mornings, stiff leg good mornings, weighted supermans, weighted ball hyperextensions, alternating row, alternating renegade row, bent over row, bent-over one-arm row, bent-over two-arm row, bent-over row with palms in, incline row, incline bench pulls, lying cambered row, middle back shrug, one-arm row, reverse grip bent-over row, bench mid row, and two-arm row.

In embodiments, the exercises and/or movements further include lateral exercises including, but are not limited to: side-lying floor stretches, shotgun rows, dynamic back stretches, and bent-arm pullovers.

In embodiments, the exercises and/or movements further include neck exercises including, but are not limited to: chin to chest stretches, isometric neck exercises-front and back, isometric neck exercises-sides, lying face down neck resistance, and lying face up neck resistance.

In embodiments, the exercises and/or movements further include forearm exercises including, but are not limited to: bottoms-up cleans from the hang position, wrist curls, lying pronation, lying supination, finger curls, palms-down wrist curls over a bench, palms-up wrist curls over a bench, plate pinches, seated palms-down wrist curls, seated palms-up wrist curls, seated one-arm palms-down wrist curls, seated one-arm palms-up wrist curls, seated palm-up wrist curls, seated palms-down wrist curls, standing palms-up behind the back wrist curls, and wrist circles.

In embodiments, the exercises and/or movements further include leg exercises including, but are not limited to: seated calf raises, one-leg seated calf raises, rocking standing calf raises, standing calf raises, standing one-leg calf raises, glute bridges, hip thrusts, kneeling jump squats, kneeling squats, pull throughs, step-ups, step-ups with knee raise, hang cleans, alternating hang cleans, good mornings, box jumps, box skips, cleans, clean deadlifts, front box jumps, glute ham raises, good mornings, hang snatches, dead cleans, one-legged deadlifts, lunge pass throughs, one-arm cleans, one-arm swings, one-arm open palm cleans, open palm cleans, power cleans, power snatches, power stairs, Romanian deadlifts, hang power cleans, stiff-legged deadlifts, snatch deadlifts, snatch pulls, split snatches, split squats, stiff-legged deadlifts, sumo deadlifts, vertical swings, wide stance stiff legs, full squats, hack squats, lunges, side split squats, squats to a bench, step ups, walking lunges, box squats, clean pulls, rear lunges, elevated back lunges, Frankenstein squats, front squats, front squats to a bench, goblet squats, jerk dip squats, pistol squats, lunge sprints, narrow stance squats, Olympic squats, one-leg barbell squats, one-arm overhead squats, one-arm side deadlifts, overhead squats, plie squats, power jerks, scissors jumps, single-leg high box squats, sit squats, single-leg split squat, speed box squats, speed squats, split cleans, split jerks, weighted jump squats, weighted sissy squats, wide stance squats, and Zercher squats.

In embodiments, the exercises and/or movements further include abdominal exercises including, but are not limited to: ¾ sit-ups, advanced windmills, air bike, side bends, bent presses, bent-knee hip raises, bosu ball crunches, Russian twists, seated crunches, cocoons, tuck reverse crunches, cross-body crunches, hands overhead crunches, legs on exercise ball crunches, crunches, dead bugs, decline crunches, decline oblique crunches, double windmills, exercise ball crunches, frog sit-ups, jackknife sit-ups, janda sit-ups, figure 8s, passes between the legs, windmills, full twists, oblique crunches, otis-ups, twists, press sit-ups, seated twists, sit-ups, spell casters, standing wood chops, supine one-arm overhead throws, supine two-arm overhead throws, toe touches, torso rotations, tuck crunches, weighted ball side bends, and weighted crunches.

A method may be utilized with embodiments of the exercise apparatus. The method may include performing one or more exercises with the exercise apparatus. A user may pick up the exercise apparatus and set their hands at a position, such as a position mentioned in the above paragraphs. The user may perform an exercise, such as an exercise mentioned in the above paragraphs. Once the user completes the exercise, the user may either keep their hands in the same position or move their hands to set their hands at another position on the exercise apparatus and subsequently perform a different exercise. Alternatively in both instances, the user may perform the same exercise that had just been performed.

Embodiments of the exercise apparatus may provide the benefit of an substantially even weight distribution throughout the apparatus, such as in a longitudinal direction from end-to-end, or in a lateral direction from side-to-side. The substantially even weight distribution enables a user to precisely control the resistance force exerted on her hand by placement of her hand at different positions on the exercise apparatus in the longitudinal direction, the lateral direction, or both. A user may be provided with a number of areas on the exercise apparatus that may be appropriate for hand configurations.

In embodiments, the weight of the exercise apparatus may be unevenly distributed.

Embodiments of the exercise apparatus may provide the benefit of stackability or storability. More than one of the exercise apparatuses may be placed front to back when the exercise apparatuses are stacked or stored in a configuration other than being stacked. When stacked or stored, the exercise apparatuses may be compact in the amount of space that is taken up. Embodiments of the exercise apparatus may provide the benefit of being used without the task of changing or assembling weights or a weighted apparatus. The single piece design saves a user time and effort when the user works out with the exercise apparatus.

Exercise Apparatus

[[ENTER FIG. 1 HERE]]

. . .

. . .

. . .

[[ENTER FIGURE X HERE]]

What is claimed is:

1. An exercise apparatus comprising:

a first frame member being elongated and defining a substantially circuital first frame portion, the first frame portion encompassing a first open interior region and a second open interior region, the first frame portion having a first interior perimeter adjacent to the first open interior region and the second open interior region, the first interior perimeter defined by the first frame member, the first frame portion having a first exterior perimeter defined by the first frame member in spaced relation to the first interior perimeter;

the first frame member having a first segment opposite a second segment, the first frame member having a third segment opposite a fourth segment, the first segment and second segment separating the third segment from the fourth segment;

a second frame member being elongated and defining a second frame portion, the second frame member spanning the first open interior region, the second frame member at opposite end portions thereof adjoining the first frame member, the second frame member along opposite sides thereof separating the first open interior region from the second open interior region;

a third frame member being elongated and defining a third frame portion and having a first end and a second end, the third frame member adjoining the first frame member at spaced first and second points on the first frame member, the first point and the second point displaced on the first exterior perimeter of the first frame member, the first end of the third frame member attached to the first frame member at the first point and the second end of the third frame member attached to the first frame member at the second point, the third frame member spanning from the first point to the second point in spaced relationship to the first exterior perimeter, the third frame portion having a second interior perimeter spaced from the third segment, the third frame portion having a third open interior region defined between the second interior perimeter and the third segment, the third segment extending from the first point to the second point, the third frame portion having a second exterior perimeter defined by the third frame member in spaced relation to the second interior perimeter; and a fourth frame member being elongated and defining a fourth frame portion and having a first end and a second end, the fourth frame member adjoining the first frame member at spaced third and fourth points on the first frame member , the third point and the fourth point displaced on the first exterior perimeter of the first frame member, the first end of the fourth frame member attached to the first frame member at the third point and the second end of the fourth frame member attached to the first frame member at the fourth point, the fourth frame member spanning from the third point to the fourth point in spaced relationship to the first exterior perimeter, the fourth frame portion having a third interior perimeter spaced from the fourth segment, the fourth frame portion having a fourth open interior region defined between the third interior perimeter and the fourth segment, the fourth segment extending from the third point to the fourth point, the fourth frame portion having a third exterior perimeter defined by the fourth frame member in spaced relation to the third interior perimeter, the third segment disposed in opposition to the fourth segment relative to the first frame portion, the third frame member disposed in opposition to the fourth frame member relative to the first segment and the second segment, the third open interior region disposed in opposition to the fourth open interior region relative to the third segment and the fourth segment, the first frame member, the second frame member, the third frame member, and the fourth frame member forming a single piece design, the first frame member, the second frame member, the fourth frame member having a similar thickness in at least one dimension and in at least one portion of each of the first frame member, the second frame member, the third frame member, and the fourth frame member, and having a similar cross-sectional shape, wherein the first frame member, the second frame member, the third frame member, and the fourth frame member are aligned along a common plane of symmetry, wherein the first and second ends of the third frame member respectively extend away from the first and second points on the first frame member along first and second linear portions of the third frame member, respectively, wherein the first and second ends of the fourth frame member respectively extend away from the third and fourth points on the first frame member along third and fourth linear portions of the fourth frame member, respectively, and wherein the first and second linear portions of the third frame member and the third and fourth linear portions of the fourth frame member are each nonparallel with both the common plane of symmetry and the second frame member.

2. The apparatus of claim 1 and further comprising:

wherein circumferences of portions of the second frame member that adjoin the first frame member are greater than an interior circumference of the second frame member.

3. The apparatus of claim 1 and further comprising:

wherein the apparatus comprises metal material.

4. The apparatus of claim 1 and further comprising:

wherein the apparatus is of a weight between 3 pounds and 25 pounds.

5. The apparatus of claim 1 and further comprising:

wherein the apparatus is of a density between 2.5 g/cm$^3$ and 23 g/cm$^3$.

6. The apparatus of claim 1 and further comprising:

wherein an arc of the third frame member is positioned a greater distance from a center point of the apparatus than an arc of the first frame member.

7. The apparatus of claim 1 and further comprising:

wherein an arc of the fourth frame member is positioned a greater distance from a center point of the apparatus than an arc of the first frame member.

8. The apparatus of claim 1 and further comprising:

wherein at least a portion of at least one of the first, the second, and the third interior and exterior perimeters is encompassed in polymeric material.

9. The apparatus of claim 1 and further comprising:

the first frame member comprising steel bar material having a substantially uniform cross-sectional profile.

10. The apparatus of claim 9 and further comprising:

the first frame member comprising a substantially circular cross-sectional profile.

11. An exercise apparatus comprising:

a first bar defining a substantially circuital first frame portion, the first bar encompassing a first open interior region and a second open interior region, the first portion frame having a first interior perimeter adjacent to the first open interior region and the second open interior region, the first frame portion having a first exterior perimeter in spaced relation to the first interior perimeter;

a second bar defining a second frame portion, the second bar spanning the first open interior region, the second bar at opposite end portions thereof adjoining the first bar at separate points on the first interior perimeter of the first bar, the second bar along opposite sides thereof separating the first open interior region from the second open interior region;

a third bar defining a third frame portion and having a first end and a second end, the third bar adjoining the first bar at spaced first and second points on the first exterior perimeter of the first frame portion, the first end of the third bar attached to the first bar at the first point and the second end of the third bar attached to the first bar at the second point, the third frame portion having a second interior perimeter and a second exterior perimeter, a fourth bar defining a fourth frame portion and having a first end and a second end, the fourth bar adjoining the first bar at spaced third and fourth points on the first bar, the first end of the fourth bar attached to the first bar at the third point and the second end of the fourth bar attached to the first bar at the fourth point, the fourth frame portion having a third interior perimeter and a third exterior perimeter;

the first bar, the second bar, the third bar, and the fourth bar forming a single piece design;

the first bar, the second bar, the third bar, and the fourth bar having a similar thickness in at least one dimension and in at least one portion of each of the first bar, the second bar, the third bar and the fourth bar, and having a similar cross-sectional shape;

wherein the first bar, the second bar, the third bar, and the fourth bar are aligned along a common plane of symmetry, wherein the first and second ends of the third bar respectively extend away from the first and second points on the first bar along first and second linear portions of the third bar, respectively, wherein the first and second ends of the fourth bar respectively extend away from the third and fourth points on the first bar along third and fourth linear portions of the fourth bar, respectively, and wherein the first and second linear portions of the third bar and the third and fourth linear portions of the fourth bar are each nonparallel with both the common plane of symmetry and the second bar.

12. The apparatus of claim 11 and further comprising: wherein circumferences of portions of the second bar that adjoin the first bar are greater than an interior circumference of the second bar.

13. The apparatus of claim 11 and further comprising: wherein the apparatus comprises metal material.

14. The apparatus of claim 11 and further comprising: wherein the apparatus is of a weight between 3 pounds and 25 pounds.

15. The apparatus of claim 11 and further comprising: wherein at least a portion of at least one of the first, the second, and the third interior and exterior perimeters is encompassed in polymeric material.

16. The apparatus of claim 15 and further comprising: wherein the polymeric material encompasses at least one separate surface area of the apparatus configured to correspond to a hand configuration.

17. The apparatus of claim 11 and further comprising: the first bar, the second bar, the third bar, and the fourth bar comprising steel bar material having a substantially uniform cross-sectional profile.

18. The apparatus of claim 17 and further comprising: the first bar comprising a substantially circular cross-sectional profile.

19. An exercise apparatus consisting essentially of:

a first frame member being elongated and defining a substantially circuital first frame portion, the first frame portion encompassing a first open interior region and a second open interior region, the first frame portion having a first interior perimeter adjacent to the first open interior region and the second open interior region, the first interior perimeter defined by the first frame member, the first frame portion having a first exterior perimeter defined by the first frame member in spaced relation to the first interior perimeter;

the first frame member having a first segment opposite a second segment, the first frame member having a third segment opposite a fourth segment, the first segment and second segment separating the third segment from the fourth segment;

a second frame member being elongated and defining a second frame portion, the second frame member spanning the first open interior region, the second frame member at opposite end portions thereof adjoining the first frame member, the second frame member along opposite sides thereof separating the first open interior region from the second open interior region;

a third frame member being elongated and defining a third frame portion and having a first end and a second end, the third frame member adjoining the first frame member at spaced first and second points on the first frame member, the first point and the second point displaced on the first exterior perimeter of the first frame member, the first end of the third frame member attached to the first frame member at the first point and the second end of the third frame member attached to the first frame member at the second point, the third frame member spanning from the first point to the second point in spaced relationship to the first exterior perimeter, the third frame portion having a second interior perimeter spaced from the third segment, the third frame portion having a third open interior region defined between the second interior perimeter and the third segment, the third segment extending from the first point to the second point, the third frame portion having a second exterior perimeter defined by the third frame member in spaced relation to the second interior perimeter;

a fourth frame member being elongated and defining a fourth frame portion and having a first end and a second end, the fourth frame member adjoining the first frame member at spaced third and fourth points on the first frame member, the third point and the fourth point on the first exterior perimeter of the first frame member, the first end of the fourth frame member attached to the first frame member at the third point and the second end of the fourth frame member attached to the first frame member at the fourth point, the fourth frame member spanning from the third point to the fourth point in spaced relationship to the first exterior perimeter, the fourth frame portion having a third interior perimeter spaced from the fourth segment, the fourth frame portion having a fourth open interior region defined between the third interior perimeter and the fourth segment, the fourth segment extending from the third point to the fourth point, the fourth frame portion having a third exterior perimeter defined by the fourth frame member in spaced relation to the third interior perimeter;

the third segment disposed in opposition to the fourth segment relative to the first frame portion;

the third frame member disposed in opposition to the fourth frame member relative to the first segment and the second segment;

the third open interior region disposed in opposition to the fourth open interior region relative to the third segment and the fourth segment;

the first frame member, the second frame member, the third frame member, and the fourth frame member forming a single piece design;

the first frame member, the second frame member, the third frame member, and the fourth frame member having a similar thickness in at least one dimension and having a similar cross-sectional shape;

wherein the first frame member, the second frame member, the third frame member, and the fourth frame member are aligned along a common plane of symmetry, wherein the first and second ends of the third frame member respectively extend away from the first and second points on the first frame member along first and second linear portions of the third frame member, respectively, wherein the first and second ends of the fourth frame member respectively extend away from the third and fourth points on the first frame member along third and fourth linear portions of the fourth frame member, respectively, and wherein the first and second linear portions of the third frame member and the third and fourth linear portions of the fourth frame member are each nonparallel with both the common plane of symmetry and the second frame member.

20. The apparatus of claim 19 and further consisting essentially of:

wherein circumferences of portions of the second frame member that adjoin the first frame member are greater than an interior circumference of the second frame member.

21. The apparatus of claim 19 and further consisting essentially of:

wherein the apparatus comprises metal material.

22. The apparatus of claim 19 and further consisting essentially of:

wherein the apparatus is of a weight between 3 pounds and 25 pounds.

23. The apparatus of claim 19 and further consisting essentially of:

wherein the apparatus is of a density between 2.5 $g/cm^3$ and 23 $g/cm^3$.

24. The apparatus of claim 19 and further consisting essentially of:

wherein an arc of the third frame member is positioned a greater distance from a center point of the apparatus than an arc of the first frame member.

25. The apparatus of claim 19 and further consisting essentially of:

wherein an arc of the fourth frame member is positioned a greater distance from a center point of the apparatus than an arc of the first frame member.

26. The apparatus of claim 19 and further consisting essentially of:

wherein at least a portion of at least one of the first, the second, and the third interior and exterior perimeters is encompassed in polymeric material.

27. The apparatus of claim 19 and further consisting essentially of:

the first frame member comprising steel bar material having a substantially uniform cross-sectional profile.

28. The apparatus of claim 27 and further consisting essentially of:

the first frame member comprising a substantially circular cross-sectional profile.

* * * * *